United States Patent [19]

Herbowy

[11] 4,220,327

[45] Sep. 2, 1980

[54] HAND-WRIST EXERCISER

[76] Inventor: Roger W. Herbowy, 2516 Genesee St., Utica, N.Y. 13502

[21] Appl. No.: 953,892

[22] Filed: Oct. 17, 1978

[51] Int. Cl.[3] ..... A63B 11/08

[52] U.S. Cl. ..... 272/67; 128/26

[58] Field of Search ..... 272/67, 116, 143, 142, 272/68, 136, 135; 128/26

[56] References Cited

U.S. PATENT DOCUMENTS

| | | | |
|---|---|---|---|
| 1,472,906 | 11/1923 | Gorrel | 272/67 |
| 3,606,316 | 9/1971 | Krewer | 128/26 |

FOREIGN PATENT DOCUMENTS

| | | | |
|---|---|---|---|
| 251870 | 3/1912 | Fed. Rep. of Germany | 272/67 |
| 1250577 | 12/1960 | France | 272/67 |

*Primary Examiner*—Richard J. Johnson

*Attorney, Agent, or Firm*—Clarence A. O'Brien; Harvey B. Jacobson

[57] ABSTRACT

An elongated horizontal rest is provided including opposite side longitudinal marginal portions and front and rear ends. A pair of opposite side uprights project upwardly from the opposite side marginal portions of the rest and a plurality of elongated tensioned elastic members extend between and are anchored relative to the uprights with the tensioned elastic members including members spaced laterally apart longitudinally of the rest and vertically apart above the rest. The forearm and/or wrist of the user may be braced against the upper surface of the rest with the hand of the user disposed beneath at least some of the elastic members for gripping the latter or flexing the fingers or hand thereagainst.

8 Claims, 3 Drawing Figures

HAND-WRIST EXERCISER

BACKGROUND OF THE INVENTION

The hand-wrist exerciser is provided for enabling post-traumatic hand and wrist exercises to be carried out in substantially all planes of movement of the wrist, hand and fingers.

There are many instances when patients must undergo hand, wrist and finger exercises as a part of post-traumatic treatment. These exercises must be begun as gentle exercises and gradually increased in difficulty as the patient's ability increases.

Various forms of finger, hand and wrist exercisers have been heretofore designed, but few are constructed in a manner to enable gentle initial resistive exercise. Further, many of the previously known exercisers do not include provisions whereby the exercises to be accomplished thereby may be gradually increased in difficulty.

Examples of previously known forms of exercisers are disclosed in U.S. Pat. Nos. 2,819,081, 2,823,918, 3,442,132 and 3,606,316.

These exercisers, however, do not include structure whereby numerous hand, wrist and finger exercises of the gentle resistive type may be initially conducted without requiring alteration of the exerciser between different types of exercises. Accordingly, a need exists for a multi-exercise type of hand, wrist and finger exerciser upon which initial gentle resistive exercises may be carried out and which may be successively adjusted for more streneous exercises as a patient's ability to exercise increases.

SUMMARY OF THE INVENTION

The exerciser of the instant invention has as its primary function to allow a patient to concentrate on all planes of movement of the wrist, hand and fingers with gentle resistance initially offered by the exerciser and with increasing resistance being available by the exerciser as the patient's ability gradually increases.

Another object of this invention is to provide an exerciser in accordance with the preceding object and which may be readily adaptable for use by a patients having different size arms, hands and wrists.

A further object of this invention is to provide an exerciser wherein different patients may successively use the same exerciser to carry out exercises of different resistance.

A final object of this invention to be specifically enumerated herein is to provided an exerciser in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
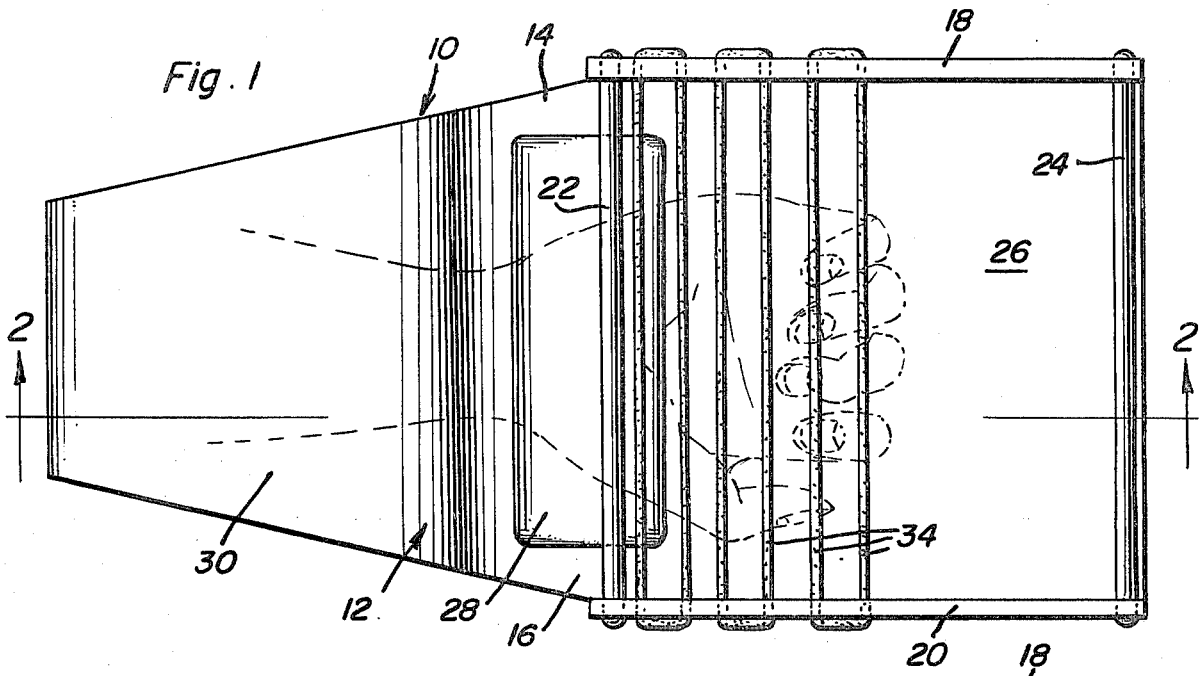
FIG. 1 is a top plan view of the exerciser of the instant invention.

Referring now more specifically to the drawings, the numeral 10 generally designates the exerciser of the instant invention. The exerciser 10 includes a horizontally elongated rest or base referred to in general by the reference numeral 12 and including opposite side longitudinal edges 14 and 16. A pair of upstanding opposite side walls 18 and 20 project upwardly and are supported from the opposite side marginal portions of the base 12 and the corresponding upper front and rear corners of the side walls 18 and 20 are rigidly interconnected by means of transverse braces 22 and 24 extending and secured therebetween.

The base or rest 12 includes a front to rear extending top wall 26 including a transverse upwardly opening partial cylindrical recess 28 extending thereacross between the forward edge portions of the side walls 18 and 20 and the forward end of the top wall 26 forwardly of the recess 28 is inclined forwardly and downwardly as at 30.

The side walls 18 and 20 are provided wih pairs of aligned bores 32 formed therethrough and the pairs of aligned bores are spaced vertically apart and longitudinally along the side walls 18 and 20.

A plurality of reaches 34 of tensioned elastic members extend between the side walls 18 and 20 and through pairs of aligned bores 32. The reaches 34 are arranged in vertically spaced sets of tensioned elastic reaches with the tensioned reaches of each set spaced apart longitudinally of the rest 12. The tensioned reaches 34 comprise integral portions of a single length of elastic surgical tubing and the reaches 34 may be increased or decreased in number, as desired.

Figure 2:
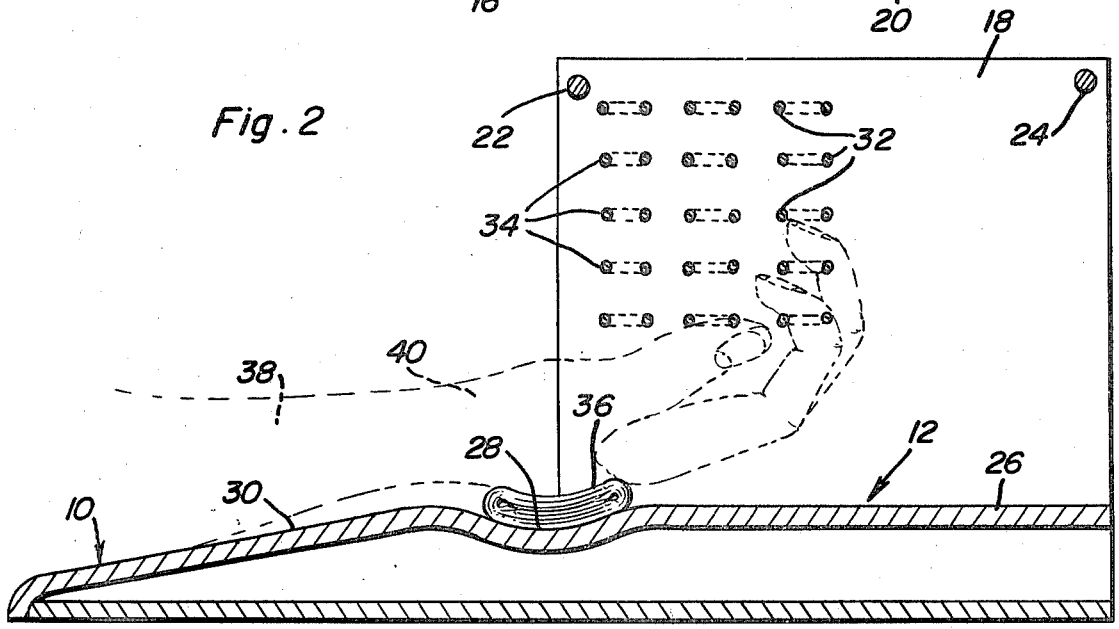
FIG. 2 is a fragmentary longitudinal vertical sectional view taken substantially upon the plane indicated by the section line 2—2 of FIG. 1.
Figure 3:
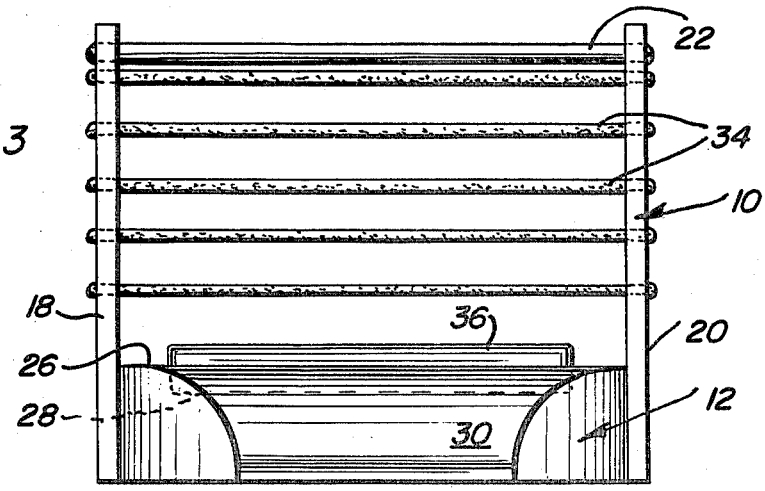
FIG. 3 is a front elevational view of the exerciser.

As may best be seen from FIG. 2 of the drawings, a small hand towel 36, or the like, may be folded and positioned in the recess 28 and the user's forearm 38 may rest upon the inclined forward end 30 of the top wall 26 with the back of the wrist 40 of the user disposed on the towel 36 and the hand of the user disposed beneath the reaches 34.

Some of the many uses of the exerciser 10 are as follows:

(A) Wrist flexion: the forearm is supinated and stabilized on the rest and the patient flexes his wrist against the resistance of the reaches 34. The resistance of the reaches 34 is given at the base of the second metacarpal bone.

(B) Flexion of metacarpophalangeal joints of the fingers: The patient uses the same starting position as in (A). However, the patient flexes at the metacarpophalengeal joints, keeping interphalangeal joints extended. Resistance is now offered by the reaches 34 on the volar surface of the proximal row of phalangeas.

(C) Flexion of proximal and distal interphalangeal joints of fingers: The patient uses the same starting position as described in exercise (A). The hand is resting on the dorsal surface and the palm is upward and the fingers are extended. The patient flexes the interphalangeal joints with resistance of the reaches 34 given at the volar surface.

(D) Flexion of metacarpophalangeal and interphalangeal joints of the thumb: The patent uses the same starting position as described in exercise (A). Resistance is given by the surgical tubing reaches 34 at the volar surface of the thumb. The patient flexes the thumb.

(E) Extension of the metacarpophalangeal joints of the thumb: The forearm is stabilized on the forearm resting portion 30 of the top wall 26 in a neutral position with the thumb upward. The patient extends the thumb with resistance of the surgical tubing reaches 34 given on the dorsal surface of the thumb.

(F) Wrist extension: The forearm is stabilized in a pronated position on the forearm rest defining forward portion of the top wall 26. The patient extends his wrist with the resistance of the surgical tubing reaches 34 given along the dorsal surface of the hand.

(G) Extension of metacarpophalangeal joints of the fingers: The patient uses the same starting position as described in exercise (F). Resistance of the surgical tubing reaches 34 is now given on the dorsal surface of the fingers as the patient extends the fingers.

In addition to the above, other wrist and finger exercises may be accomplished.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hand, wrist, finger and thumb exerciser including an elongated horizontal rest having opposite side longitudinal marginal portions and front and rear ends, a pair of opposite side uprights projecting upwardly from said longitudinal marginal portions, and a plurality of elongated tensioned elastic members each extending between and anchored relative to said uprights, said tensioned elastic members including vertically spaced sets of tensioned members spaced above said rest with the tensioned members of each set spaced apart longitudinally of said rest, said rest being adapted to have the forearm and/or wrist of the user braced against its upper surface with the hand of the user disposed beneath at least some of the elastic members for gripping the latter or for flexing the fingers or hand thereagainst, said elastic members comprising longitudinally spaced sections of a single elongated elastic tension member threaded through said uprights.

2. The combination of claim 1 wherein said rest front end projects forwardly of said opposite side uprights and is forwardly and downwardly inclined.

3. The combination of claim 2 wherein said rest includes a transverse upwardly opening recess formed therein in substantial transverse alignment with the forward extremities of said uprights.

4. A hand, wrist, finger and thumb exerciser including an elongated horizontal rest having opposite side longitudinal marginal portions and front and rear ends, a pair of opposite side uprights projecting upwardly from said longitudinal marginal portions, a plurality of elongated tensioned elastic members each extending between and anchored relative to said uprights, said tensioned elastic members being spaced apart longitudinally of said rest and also spaced vertically apart above said rest, said rest being adapted to have the forearm and/or wrist of the user braced against its upper surface with the hand of the user disposed beneath at least some of the elastic members for gripping the latter or for flexing the fingers or hand thereagainst, said elastic members comprising longitudinally spaced sections of a single elongated elastic tension member threaded through said uprights.

5. A hand, wrist, finger and thumb exerciser including an elongated horizontal rest having opposite side longitudinal marginal portions and front and rear ends, a pair of opposite side uprights projecting upwardly from said longitudinal marginal portions, a plurality of elongated tensioned elastic members each extending between and anchored relative to said uprights, said tensioned elastic members being spaced apart longitudinally of said rest and also spaced vertically apart above said rest, said rest being adapted to have the forearm and/or wrist of the user braced against its upper surface with the hand of the user disposed beneath at least some of the elastic members for gripping the latter or for flexing the fingers or hand thereagainst, said uprights comprising upstanding opposite side walls extending along said longitudinal marginal portions, said side walls being provided with pairs of aligned bores formed therethrough, said tensioned elastic members comprise longitudinally spaced reach portions of a single elongated elastic member threaded through selected pairs of said bores.

6. The combination of claim 5 wherein said elastic member comprises a length of surgical tubing.

7. The combination of claim 6 wherein said rest front end projects forwardly of said opposite side uprights and is forwardly and downwardly inclined.

8. The combination of claim 7 wherein said rest includes a transverse upwardly opening recess formed therein in substantial transverse alignment with the forward extremities of said uprights.

* * * * *